US009151010B2

(12) United States Patent
Ong

(10) Patent No.: US 9,151,010 B2
(45) Date of Patent: Oct. 6, 2015

(54) ARTICLE FOR JOINING CONCRETE PILES

(71) Applicant: Chin Chai Ong, Kuala Lumpur (MY)

(72) Inventor: Chin Chai Ong, Kuala Lumpur (MY)

( * ) Notice: Subject to any disclaimer, the term of this patent is extended or adjusted under 35 U.S.C. 154(b) by 0 days.

(21) Appl. No.: 14/364,243

(22) PCT Filed: Sep. 13, 2013

(86) PCT No.: PCT/MY2013/000169
§ 371 (c)(1),
(2) Date: Jun. 10, 2014

(87) PCT Pub. No.: WO2014/058298
PCT Pub. Date: Apr. 17, 2014

(65) Prior Publication Data

US 2014/0377012 A1 Dec. 25, 2014

(30) Foreign Application Priority Data

Oct. 8, 2012 (MY) ..... PI 2012700742

(51) Int. Cl.
*E02D 5/30* (2006.01)
*E02D 5/24* (2006.01)

(52) U.S. Cl.
CPC ... *E02D 5/30* (2013.01); *E02D 5/24* (2013.01)

(58) Field of Classification Search
CPC ..... E02D 5/30; E02D 5/523; E02D 5/526; E04B 1/215
USPC ..... 405/252
See application file for complete search history.

(56) References Cited

U.S. PATENT DOCUMENTS

| | | | | | |
|---|---|---|---|---|---|
| 2,698,519 | A | | 1/1955 | Lloyd | |
| 3,104,532 | A | * | 9/1963 | Severinsson | 405/252 |
| 3,356,398 | A | * | 12/1967 | Nilsson et al. | 403/331 |
| 3,422,630 | A | * | 1/1969 | Marier | 405/252 |
| 4,157,230 | A | * | 6/1979 | Tomt et al. | 405/252 |
| 4,604,003 | A | * | 8/1986 | Francoeur et al. | 405/256 |
| 4,605,340 | A | * | 8/1986 | Stephan | 405/252 |

(Continued)

FOREIGN PATENT DOCUMENTS

| | | |
|---|---|---|
| JP | 10195868 | 7/1998 |
| JP | 2006002560 | 1/2006 |

(Continued)

OTHER PUBLICATIONS

International Search Report for PCT/MY2013/000169, Completed by the Japanese Patent Office on Jan. 15, 2014, 2 Pages.

*Primary Examiner* — Benjamin Fiorello
(74) *Attorney, Agent, or Firm* — Brooks Kushman P.C.

(57) ABSTRACT

An article for joining concrete piles having an annular plate mounted at one end of the pile, a central opening, a front surface an obverse surface and an interlocking profile having a plurality of first and second complementary configurations. Each configuration is defined in a substantially equalized sector and arranged radially in an alternate fashion on the front surface, the first configuration is a protrusion and the second configuration is a recess, wherein the lateral edges of each protrusion carries a horizontally extending groove. When mating of two identical articles, each mounted at the ends of two separate piles, the protrusions of one article mate with the recesses of another article forming of a passageway by two adjacently positioned grooves of two contiguous protrusions of the mated articles, the passageway allows interlocking of the mated articles by inserting a pin there through.

18 Claims, 9 Drawing Sheets

(56) References Cited

U.S. PATENT DOCUMENTS

| | | | | |
|---|---|---|---|---|
| 2010/0322717 | A1* | 12/2010 | Paul | 405/252 |
| 2011/0002744 | A1* | 1/2011 | Tadros et al. | 405/232 |
| 2014/0241816 | A1* | 8/2014 | Koivunen | 405/252 |

FOREIGN PATENT DOCUMENTS

| | | |
|---|---|---|
| JP | 2006037619 | 2/2006 |
| JP | 2006207117 | 8/2006 |

* cited by examiner

ARTICLE FOR JOINING CONCRETE PILES

CROSS-REFERENCE TO RELATED APPLICATION

This application is the U.S. national phase of PCT Application No. PCT/MY2013/000169 filed on Sep. 13, 2013, which claims priority to MY Patent Application No. PI 2012700742 filed on Oct. 8, 2012, the disclosures of which are incorporated in their entirety by reference herein.

FIELD OF INVENTION

The present invention relates to an article for joining concrete piles. The piles are joined together by mating two identical articles that are each mounted at the end of a pile.

BACKGROUND OF THE INVENTION

Concrete piles that are driven to the ground serve to provide foundation support to structures. Weight of the structure is distributed by the piles in order to reduce the risk of structural failure. Precast piles that are reinforced with rebar are commonly prestressed to enhance its tensile stress resistance for reducing cracking. However, the ultimate strength in axial compression is inversely proportional to the level of prestressing such that when the level of prestressing increases, the ultimate strength in axial compression decreases.

As a single long slender concrete pile is prone to breakage during lifting, therefore such long concrete pile is often installed by dividing the pile into multiple sections and stacking them atop one another. Moreover, by employing multiple joined pile sections, long piles can be driven. The pile sections are joined end-to-end by pile splices or connectors. An example of such pile connector is known in U.S. Pat. No. 4,157,230, whereby a nut is constructed within the joining ends of the two pile sections for a threaded bolt to be fastened to the nuts. The nut is provided with an annular groove having radially directed locking notches in the bottom. A locking disk is inserted into the groove. The disk has resilient locking tongues with radial edges which are directed against the unscrewing direction and which engage with the notches in the nut.

U.S. Pat. No. 2,698,519 discloses another concrete pile connector that is utilized to join two sectional cast concrete piles which have longitudinal metal reinforcing rods therein. The connector has a first annular band-like metal ring secured to and surrounding certain reinforcing rods at an end portion of a first pile section. The outer surface of the ring conforms to the contour of the outer surface of the end portion of the first pile section. A second annular band-like metal ring with the same design and configuration as the first annular band-like metal ring is secured to the end portion of a second pile section. Both rings are connected by having the two end portions of a tubular metal sleeve that encompasses the abutting ends of the first and second pile sections to be respectively welded to the first and second ring.

The pile connectors from the prior arts mentioned above are used for precast concrete pile but is not adapted to be incorporated into prestressed spun piles manufacturing as it obstruct the prestressing jack equipment, and the non-symmetry will induced irregular vibrations during the pile spinning process. This present invention is specially adapted for the fabrication of spun piles without having to additionally modify the existing spun pile mould or the prestressing equipment. The interlocking profile of the present invention can be incorporated and replaced into the existing annular steel rings for spun pile joints. This present invention introduces a pair of complementary pile connectors that not only contributes to the simple and easy joining of concrete pile sections but also ensures that the strength of the connectors is greater than the ultimate bending, compressive and tensile capacity of the intact concrete section of the pile.

SUMMARY OF INVENTION

The main aspect of the present invention is to provide an article for joining concrete piles, in particular adapted to the manufacturing of presstresed spun piles.

Another aspect of the present invention is to provide an article for joining concrete piles that is able to resist greater or at least full bending, compressive and tensile capacity of the intact pile section.

Still another aspect of the present invention is to provide an article for joining concrete piles that has an easy to construct interlocking profile.

Yet another aspect of the present invention is to provide an article for joining concrete piles that are easy to be installed to the end of the concrete piles.

Also another aspect of the present invention is to provide an article for joining concrete piles that do not require a male and female locking mechanism.

Also another aspect of the present invention is to provide an article for joining concrete piles that has a slanted inward V-shaped protrusion with provision of a gap to allow tolerances due to misalignment during the mating of the interlocking profiles.

At least one of the preceding aspects is met, in whole or in part, by the present invention, in which the embodiment of the present invention describes an article (100) for joining concrete piles (110) comprising an annular plate which is mounted at one end of the pile (110), having a central opening (108), a front surface and an obverse surface; and an interlocking profile having a plurality of first and second complementary configurations, each configuration is defined in a substantially equal-sized sector and arranged radially in an alternate fashion on the front surface, that the first configuration is a protrusion (101) and the second configuration is a recess (102), wherein the lateral edges (106) of each protrusion (101) carries a horizontally extending groove (104); whereby mating of two identical articles (100), that are each mounted at the ends of two separate piles (110), at the interlocking profiles through registering the protrusions (101) of one article (100) to the recesses (102) of another article (100) leads to the formation of a passageway (107) by two adjacently positioned grooves (104) of two contiguous protrusions (101) of the mated articles (100), the passageway (107) allows interlocking of the mated articles (100) by inserting a pin (105) therethrough.

A second preferred embodiment of the present invention comprises an annular plate which is mounted at one end of the pile having a central opening (201), a front surface and an obverse surface; and an interlocking profile having a plurality of first and second complementary configurations, each configuration is defined in a substantially equal-sized sector and arranged radially in an alternate fashion on the front surface, that the first configuration has a segmental recess (202) coupled with a non-segmental protrusion (203) within the sector while the second configuration has a non-segmental recess (204) coupled with a segmental protrusion (205) within the sector, wherein the edges of the segmental protrusions (205) and non-segmental (203) protrusions that are adjacent to the recesses (202, 204) carry a first groove (214); whereby mating of two identical articles (200), that are mounted at the ends of two separate piles (218), at the interlocking profiles through registering the protrusions (203, 205) of one article (200) to the recesses (202, 204) of another article (200) leads to the formation of a first passageway (206) by two adjacently positioned first grooves (214) of a pair of contiguously placed non-segmental protrusion (203) and segmental protrusion (205) of the mated articles (200), the first passageway (206) allows interlocking of the mated articles (200) by inserting a first pin (209) therethrough.

A third preferred embodiment of the present invention describes an article (300) that could be manufactured in various shapes comprises a plate which is mounted at one end of the pile, having a central opening (308), a front surface and an obverse surface; and an interlocking profile having a plurality of first and second configurations, each configuration is defined as a section arranged in an alternate fashion on the front surface, that the first configuration is a protrusion (301) and the second configuration is a recess (302) that complements to the first configuration, wherein the lateral edges (306) of each protrusion (301) diverge from the central opening (308) and carry a horizontally extending groove (304); whereby mating of two identical articles (300), that are each mounted at the ends of two separate piles, at the interlocking profiles through registering the protrusions (301) of one article (300) to the recesses (302) of another article (300) leads to the formation of a passageway (307) by two adjacently positioned grooves (304) of two contiguous protrusions (301) of the mated articles (300), the passageway (307) allows interlocking of the mated articles (300) by inserting a pin (305) therethrough.

DETAILED DESCRIPTION OF THE INVENTION

Figure 1:
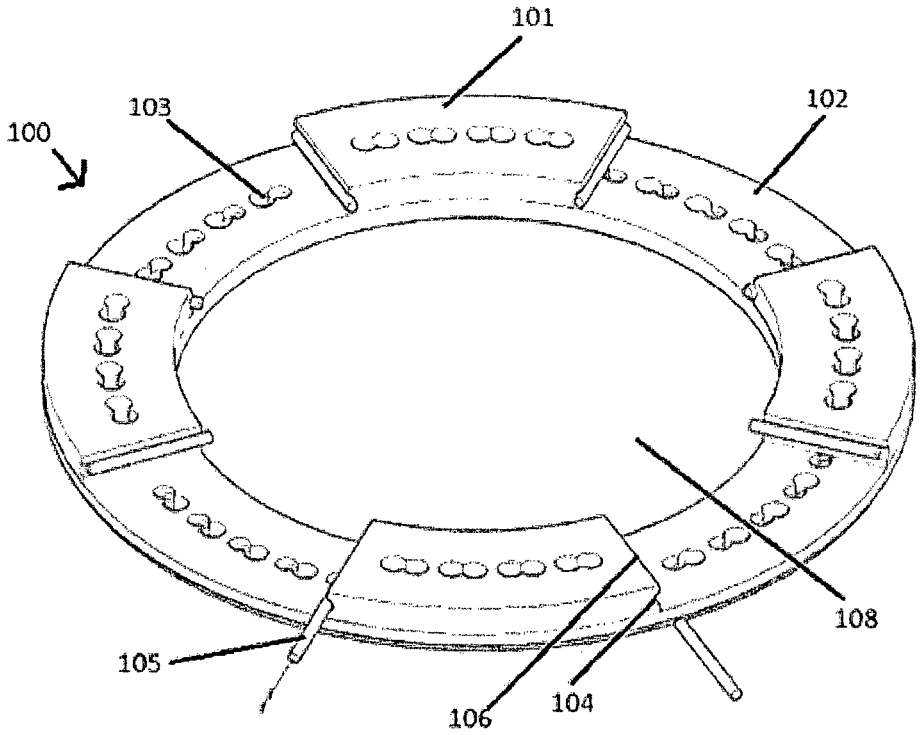
FIG. 1 is a diagram showing the front surface of the first preferred embodiment of the present invention.
Figure 2:
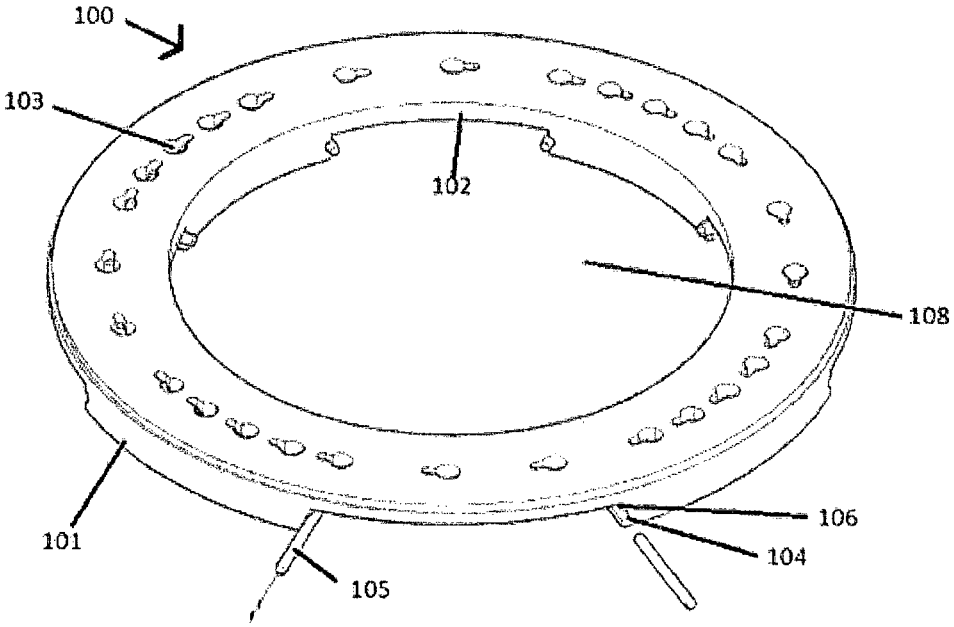
FIG. 2 is a diagram showing the obverse surface of the first preferred embodiment of the present invention.

Referring to FIG. 1 and FIG. 2, the present invention discloses an article (100) for joining concrete piles (110) comprising an annular plate which is mounted at one end of the pile (110), having a central opening (108), a front surface and an obverse surface; and an interlocking profile having a plurality of first and second complementary configurations, each configuration is defined in a substantially equal-sized sector and arranged radially in an alternate fashion on the front surface, that the first configuration is a protrusion (101) and the second configuration is a recess (102), wherein the lateral edges (106) of each protrusion (101) carries a horizontally extending groove (104); whereby mating of two identical articles (100), that are each mounted at the ends of two separate piles (110), at the interlocking profiles through registering the protrusions (101) of one article (100) to the recesses (102) of another article (100) leads to the formation of a passageway (107) by two adjacently positioned grooves (104) of two contiguous protrusions (101) of the mated articles (100), the passageway (107) allows interlocking of the mated articles (100) by inserting a pin (105) therethrough.

Figure 3:
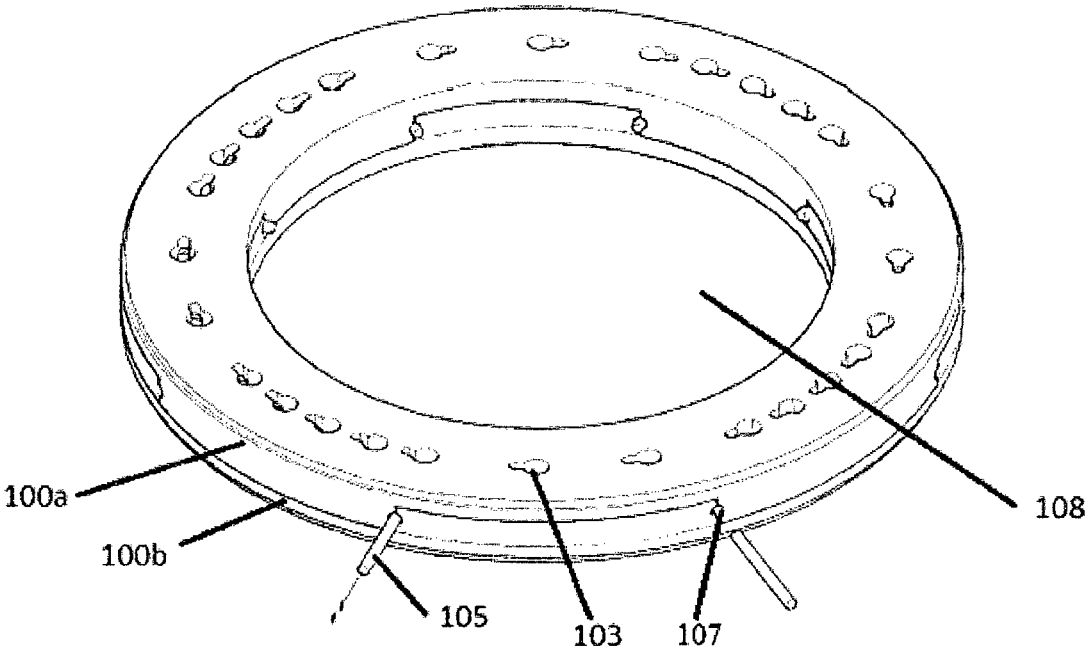
FIG. 3 shows a diagram of two separate articles of the first preferred embodiment of the present invention that are mated together.
Figure 5:
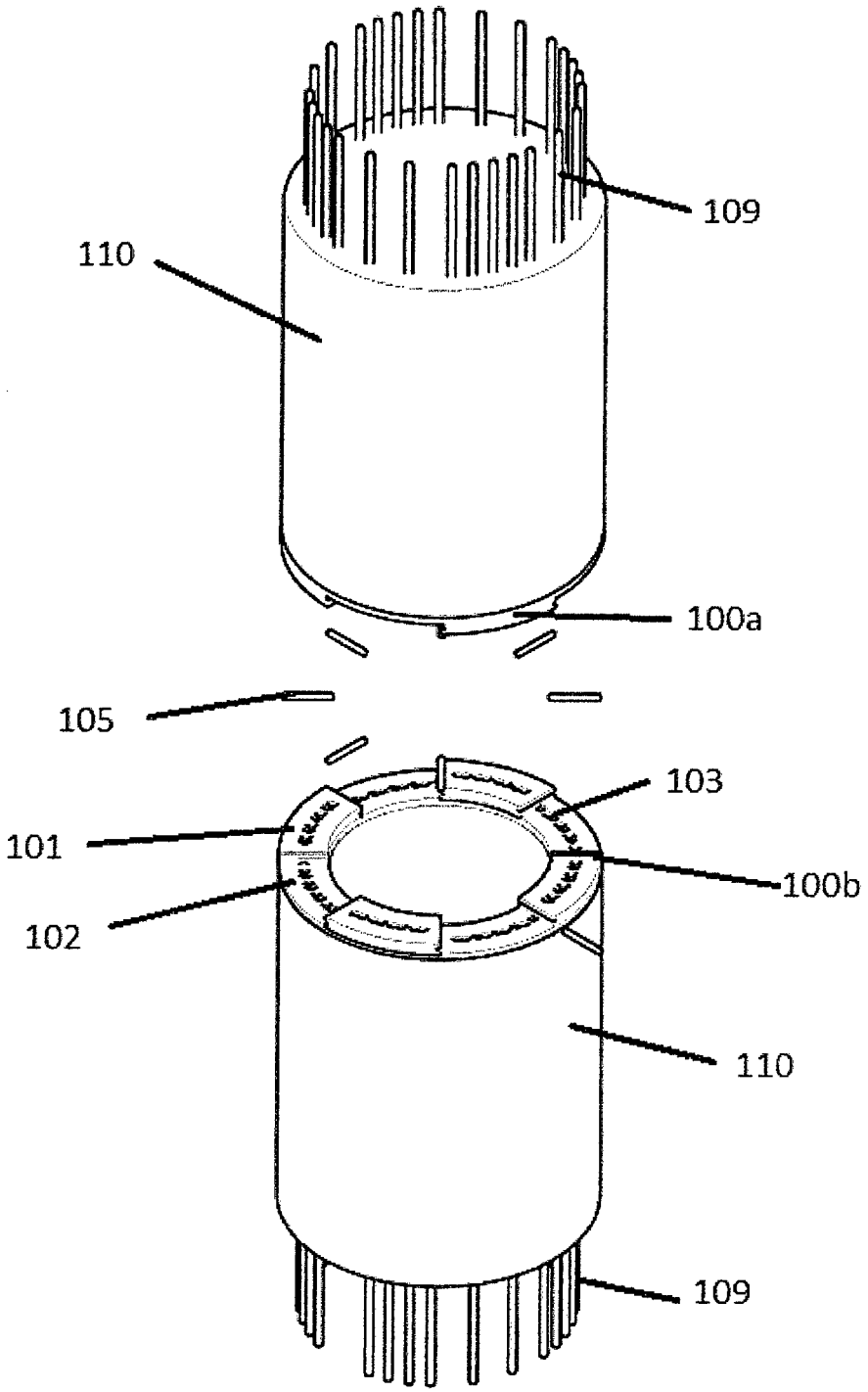
FIG. 5 is an exploded view of the first preferred embodiment of the present invention that is applied to connect two piles together.

Whilst the application of the present invention is not limited to certain type of pile, the annular shape of the article (100) with the central opening (108) makes the present invention suitable to be employed as a pile connector for spun piles (110) as spun piles (110) are constructed in round and hollow in cross section. Each article (100) is mounted respectively at the ends of two piles (110) which are opposingly facing each other as shown in FIG. 5. The piles (110) are joined vertically with one stacking atop another. The obverse surfaces of the plates are mounted at the end of the pile (110) and the front surfaces of the plates of the two piles (110) face each other such that the articles (100) are mated together at the interlocking profiles as shown in FIG. 3.

With reference to FIG. 1, each protrusion (101) and recess (102) are fabricated with at least a hole (103) for receiving the rebars (109) of the piles (110). The holes (103) are preferably in the shape of two merged circles, one of which has a larger diameter than the other to ease the insertion of the rebar (109) that is pulled towards the circle of the smaller diameter from the circle with larger diameter to secure the rebar (109) in place by a group of prestress jacking machine. Therefore, the array, shape and position of the holes (103) must be designed to adapt to the prestress jacking machine. Also, the amount and position of the holes must comply with the number and position of the rebars (109) of the piles (110).

Figure 4:
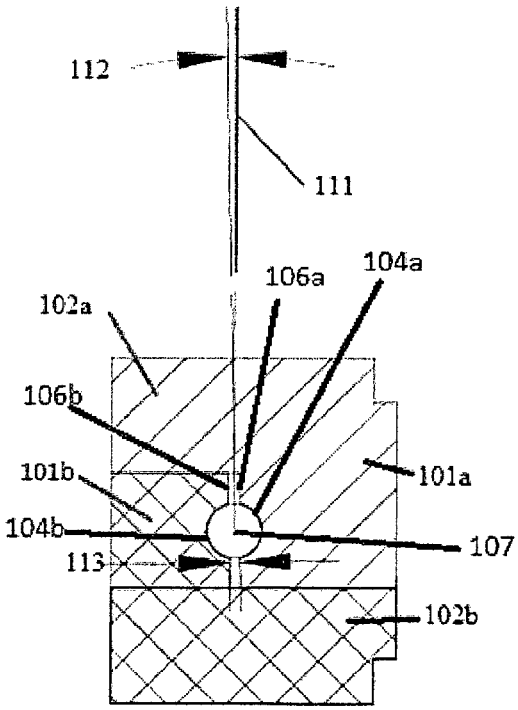
FIG. 4 is an inner side view of two mated articles of the first preferred embodiment showing protrusions of one article being registered to the recesses of another article.

FIG. 4 shows that the lateral edges (106) are tapered upwards at an angle (112) of less than 3° in relative to the vertical axis (111) of the lateral edge (106) parallel to the longitudinal axis of the pile (110). In addition to that, the mated articles (100) have a gap (113) of 1 mm to 5 mm formed between the lateral edges of the contiguous protrusions (101). The provision of the gap (113) and tapered lateral edge (106) is to provide a narrowing into the slight "V" shaped protrusion (101) for easy mating into the recesses (102) between the two piles (110) at the connecting ends. It should be noted that the term 'contiguous protrusions' described herein refers to two adjacently positioned protrusions from two separate articles which are mated together. With such characteristic of the lateral edge and the existence of the gap, a tolerance is provided between the two contiguous protrusions (101) for the pin (105) to be inserted into the passageway (107) as well as for the protrusions (101) of one article (100*a*) to fit onto the recesses (101) of another article (100*b*) easily. Besides that, the passageway (107) is tapered towards the central opening (108), resulting in the formation of a bigger opening of the passageway (107) for the pin (110) to be inserted into the passageway (107) easily. The tapering of the passageway (107) also causes the diameter of the passageway (107) to decrease gradually towards the central opening (108) such that the pin (105) could be fitly secured within the passageway (107).

By adjacently positioning the grooves (104) of two contiguous protrusions (101), the passageway (107) formed allows the pin (105) that has a complementary diameter to fit into the opening of the passageway (107) for interlocking the mated articles (100). The two adjacent grooves (104) of the mated articles (100) that form the passageway (107) has a cross-sectional shape of either oval, rectangular, square or circular. Preferably, the pin has a diameter greater than the larger tapered radius of the passageway (107) yet smaller than the diameter of the opening to the passageway (107). Such requirement for the size of the pin (105) is important to ensure tight security of the pin (105) by the grooves (104) of the contiguous protrusions (101) so that the pin (105) does not dislodge from the passageway (107).

Figure 6:
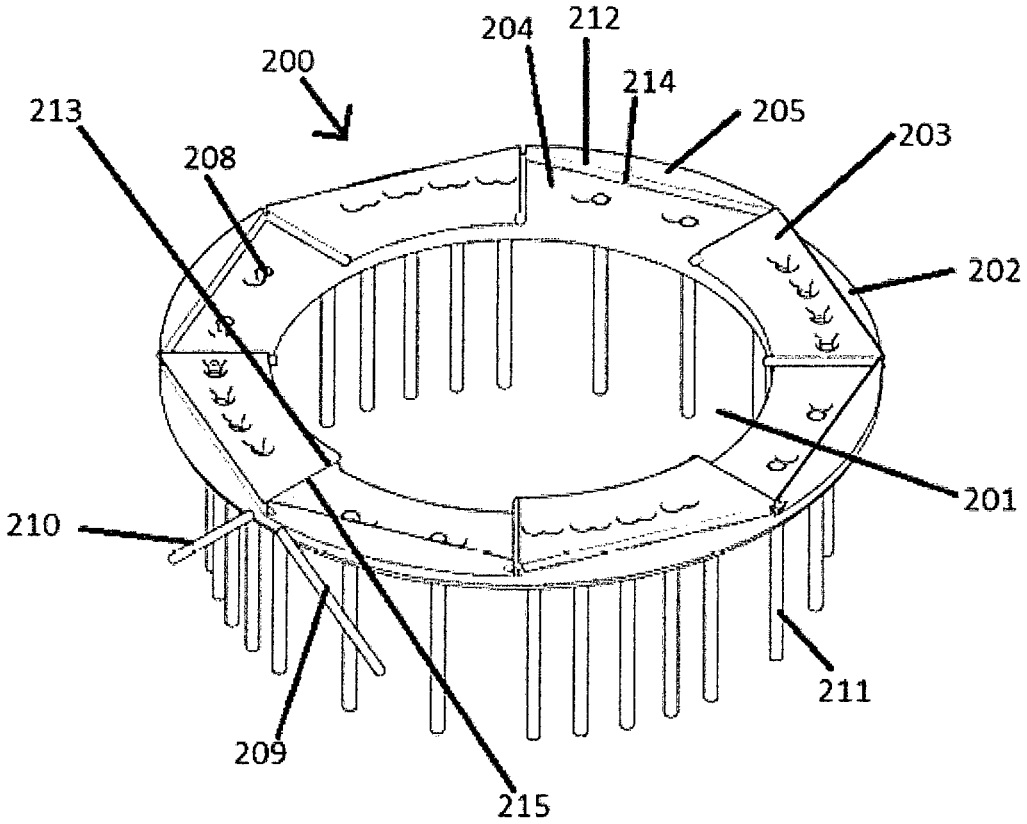
FIG. 6 is a diagram showing the front surface of the second preferred embodiment of the present invention.
Figure 7:
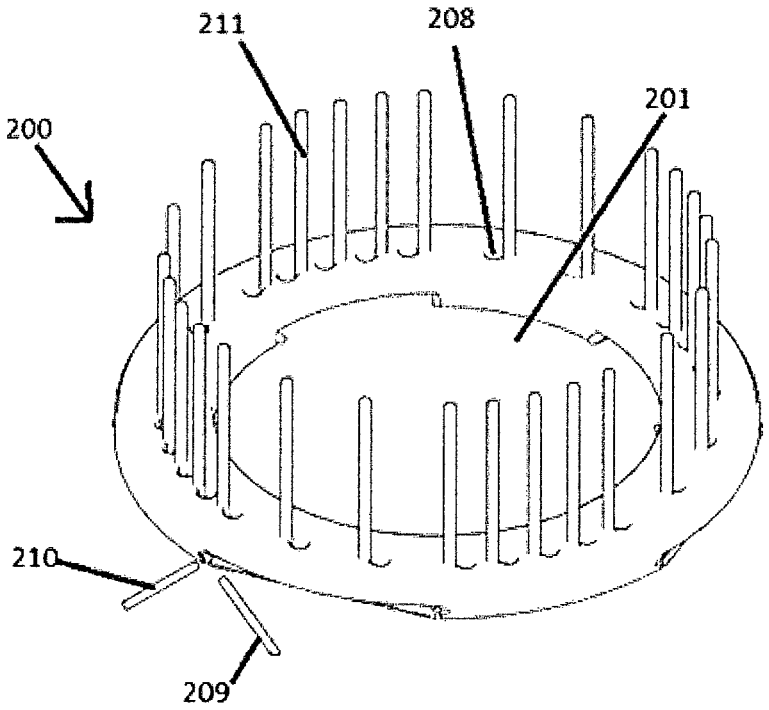
FIG. 7 is a diagram showing the obverse surface of the second preferred embodiment of the present invention.
Figure 8:
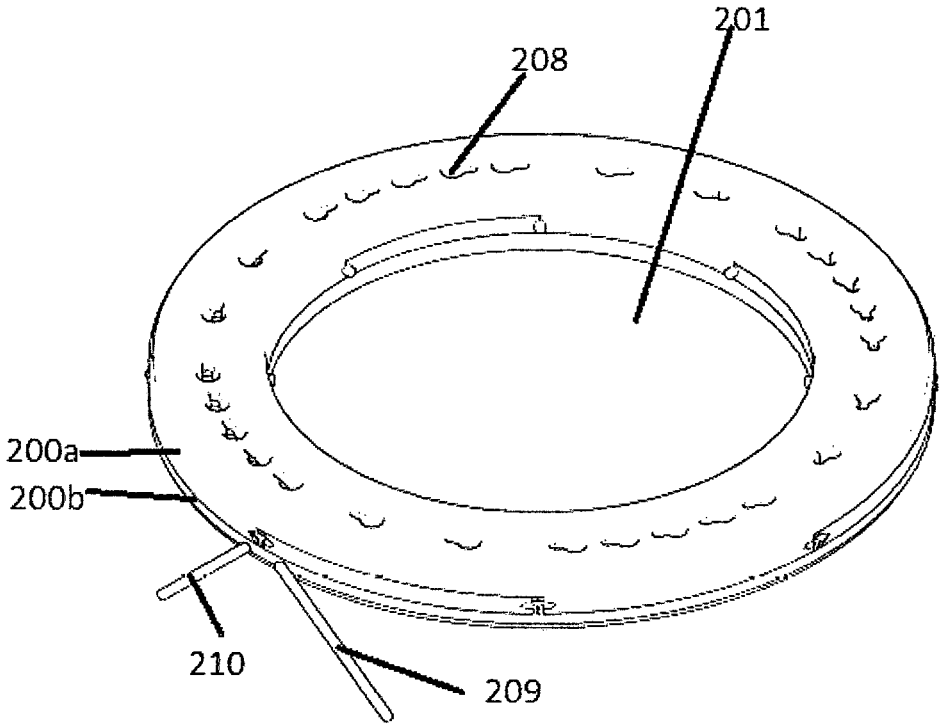
FIG. 8 shows a diagram of two separate articles of the second preferred embodiment of the present invention that are mated together without having the rebars of the piles inserted to the holes.
Figure 9:
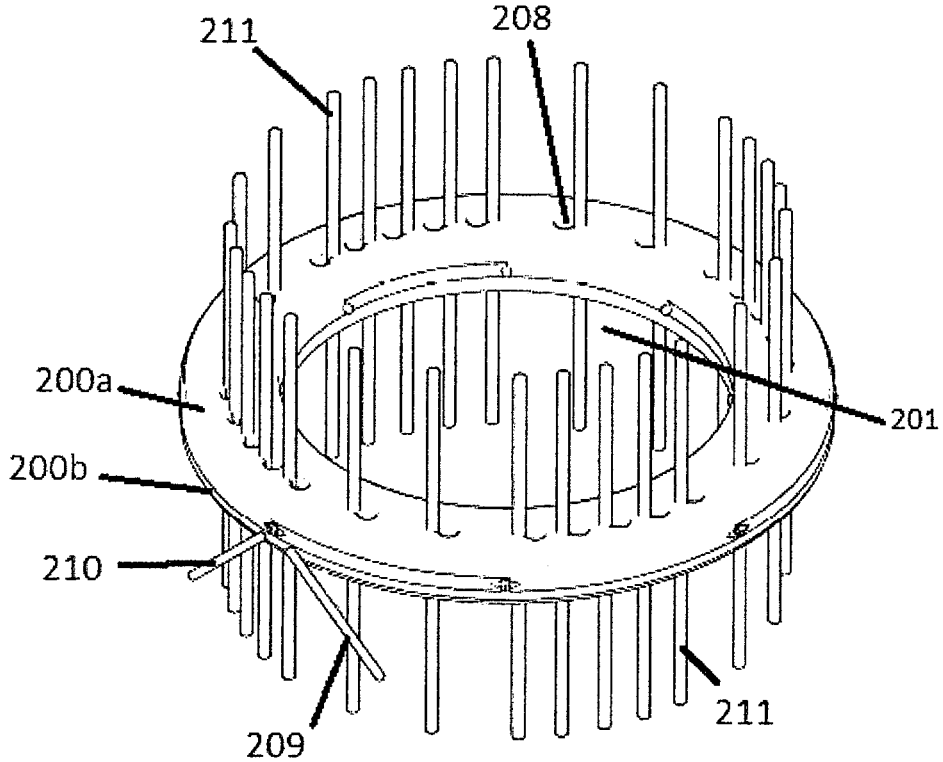
FIG. 9 shows a diagram of two separate articles of the second preferred embodiment of the present invention that are mated together with rebars of the piles inserted to the holes.

A second preferred embodiment of the present invention with different configurations in its interlocking profile on the front surface of the article (200) serves the same function as the first preferred embodiment. With reference to FIG. 6 and FIG. 7, the second preferred embodiment comprises an annular plate which is mounted at one end of the pile (218) having a central opening (201), a front surface and an obverse surface; and an interlocking profile having a plurality of first and second complementary configurations, each configuration is defined in a substantially equal-sized sector and arranged radially in an alternate fashion on the front surface, that the first configuration has a segmental recess (202) coupled with a non-segmental protrusion (203) within the sector while the second configuration has a non-segmental recess (204) coupled with a segmental protrusion (205) within the sector, wherein the edges (212) of the non-segmental (203) and segmental (205) protrusions that are adjacent to the recesses (202, 204) carry a first groove (214); whereby mating of two identical articles (200), that are mounted at the ends of two separate piles (218), at the interlocking profiles through registering the protrusions (203, 205) of one article (200) to the recesses (202, 204) of another article (200) leads to the formation of a first passageway (206) by two adjacently positioned first grooves (214) of a pair of contiguously placed non-segmental protrusion (203) and segmental protrusion (205) of the mated articles (200), the first passageway (206) allows interlocking of the mated articles (200) by inserting a first pin (209) therethrough.

As illustrated in FIG. 6, the non-segmental protrusions (203) and non-segmental recesses (204) are fabricated with at least a hole (208) for receiving the rebars (211) of the piles (218). Preferably, the holes (208) are in the shape of a two merged circles, one of which has a larger diameter than the other to ease the insertion of the rebar (211) in which the rebar is slotted into the circle with the larger diameter and pulled towards the circle with the smaller diameter to secure the rebar (211) in place by a machine. The amount and position of the holes (208) must match with the position of the rebars (211) of the piles (218).

Figure 10:
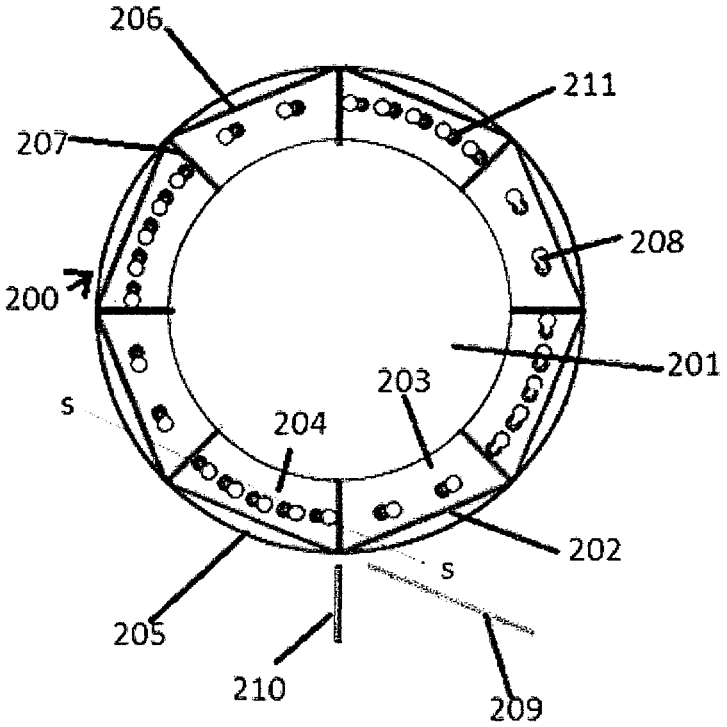
FIG. 10 shows a top view of the mated articles of the second preferred embodiment of the present invention.
Figure 11:
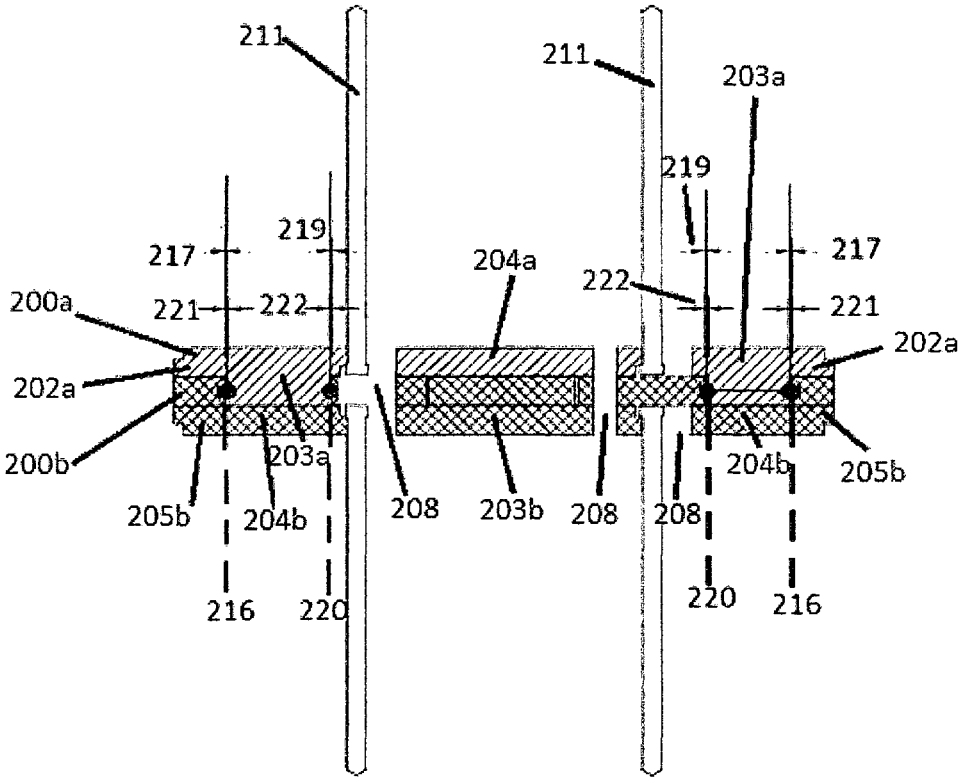
FIG. 11 is the S-S cross section of the top view of the second preferred embodiment of the present invention from FIG. 10.
Figure 12:
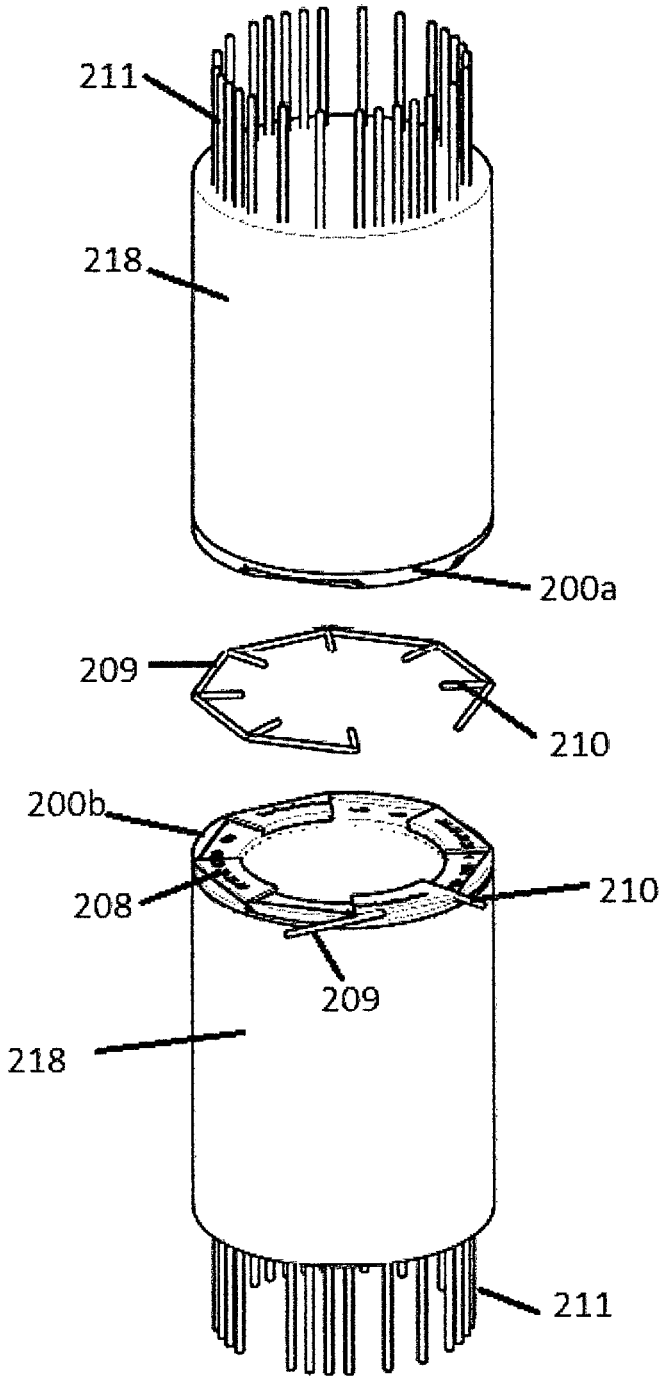
FIG. 12 is an exploded view of the second preferred embodiment of the present invention that is applied to connect two piles together.

Referring to FIG. 11 which is the S-S cross section of the mated articles (200) shown in FIG. 10, the edges (212) of the segmental (205) and non-segmental (203) protrusions that are adjacent to the recesses (202, 204) are tapered upwards at a first angle (217) of less than 3° in relative to the vertical axis (216) of the edges (212) that is parallel to the longitudinal axis of the pile (218). Also, the mated articles (200) have a first gap (221) of 1 mm to 5 mm formed between the contiguously placed non-segmental protrusion (203) and segmental protrusion (205). The tapered feature of the edges (212) and the first gap (221) are constructed to provide tolerance for the protrusions (203, 205) of the two mated articles (200) to be easily fitted onto the recesses (202, 204) as well as for the first pin (209) to be inserted into the first passageway (206) easily.

On the other hand, the lateral edges (213) of each protrusion (203, 205) is fabricated with a horizontally extending second groove (215) such that a second passageway (207) is formed by two adjacently positioned second grooves (215) of two contiguous non-segmental protrusions (203) and two contiguous segmental protrusions (205) of the mated articles (200). The second passageway (207) allows interlocking of the mated articles (200) by inserting a second pin (210) therethrough.

Similar to the first preferred embodiment, the lateral edges (213) of the protrusions (203, 205) are also preferred to be tapered upwards at a second angle (219) of less than 3° in relative to the vertical axis (220) of the lateral edge (213) that is parallel to the longitudinal axis of the pile (218) as shown in FIG. 11. Furthermore, the mated articles (200) have a second gap (222) of 1 mm to 5 mm formed between the two contiguous non-segmental protrusions (203) as well as between the two contiguous segmental protrusions (205). The construction of the tapered lateral edges (213) and second gap allow tolerances to be provided in between every two contiguous non-segmental protrusions (203) and two contiguous segmental protrusions (205) to ease the mating of the articles (200). The provision of the gaps (221, 222) as well as tapered edges (212) of the protrusions (203, 205) that are adjacent to the recesses (202, 204) and the tapered lateral edges (214) is to provide a narrowing into the slight "V" shaped non-segmental protrusion (203) and segmental protrusion (205) for easy mating into the recesses (202, 204) between the two piles (218) at the connecting ends.

The second passageway (207) of the protrusions (203, 205) are tapered towards the central opening (201), causing the second passageway (207) to have a gradually decreasing diameter. Such design of the second passageway (207) not only contributes to the ease of insertion of the second pin (210) due to the opening of the second passageway (207) having a diameter large enough for the pin to be inserted thereinto, but also helps to secure the second pin (210) tightly by the gradually decreasing diameter of the second passageway (207) towards the central opening (201).

The first (209) and second (210) pin have a complementary diameter to fit into the opening of the first (206) and second (207) passageway respectively. Both the first pin (209) and second pin (210) are preferred to have a diameter greater than the larger tapered radius of the first passageway (206) and second passageway (207) yet smaller than the diameters of the opening of the passageways (206, 207) so that the pins (209, 210) could be firmly secured by the grooves (214, 215) of the contiguous protrusions (203, 205) of the mated articles (200) for preventing dislodgement of the pins (209, 210).

As clearly illustrated in FIG. 6 and FIG. 10, the segmental recesses (202) and segmental protrusions (205) are bounded by a chord and an arc of the plate between the chord's end-points whereas the non-segmental recesses (204) and non-segmental protrusions (203) are bounded by two radii and a chord between the radii. The chord is the edge line between a segmental protrusion (205) and its adjacent non-segmental recess (204) as well as the edge line between a non-segmental protrusion (203) and its adjacent segmental recess (202). It is important that the position of the chords does not coincide with the holes (208) such that the pins (209, 210) inserted into the passageways (206, 207) do not go through the holes (209, 210) that are exclusively used for the insertion of the rebars (211). Also, the first passageway (206) and the second passageway (207) formed have a cross-sectional shape that could be oval, rectangular, square but preferably circular.

The present invention also introduces a third preferred embodiment which could be applied to join various types of piles that are circular or non-circular including square piles. The article (300) comprises a plate which is mounted at one end of the pile, having a central opening (308), a front surface and an obverse surface; and an interlocking profile having a plurality of first and second configurations, each configuration is defined as a section arranged in an alternate fashion on the front surface, that the first configuration is a protrusion (301) and the second configuration is a recess (302) that complements to the first configuration, wherein the lateral edges (306) of each protrusion (301) diverge from the central opening (308) and carry a horizontally extending groove (304); whereby mating of two identical articles (300), that are each mounted at the ends of two separate piles, at the interlocking profiles through registering the protrusions (301) of one article (300) to the recesses (302) of another article (300) leads to the formation of a passageway (307) by two adjacently positioned grooves (304) of two contiguous protrusions (301) of the mated articles (100), the passageway (307) allows interlocking of the mated articles (300) by inserting a pin (305) therethrough.

Figure 13:
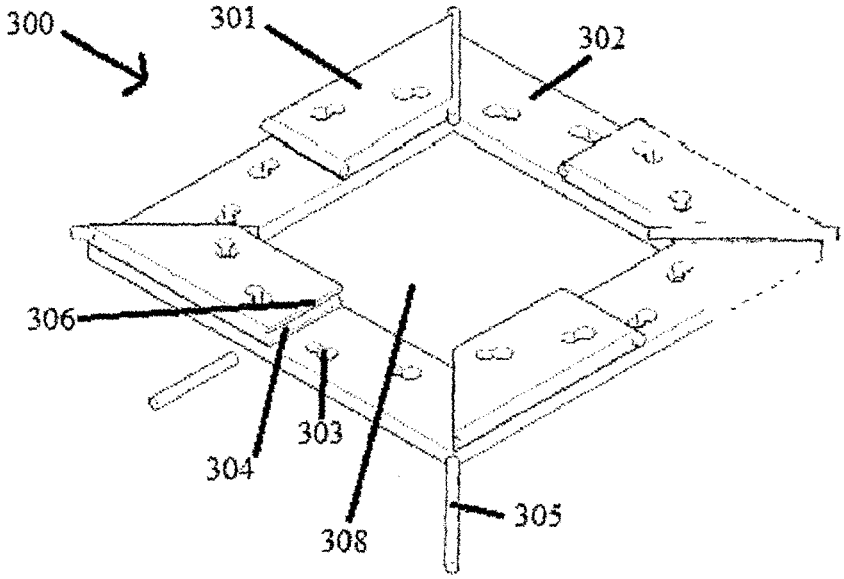
FIG. 13 is a diagram showing the front surface of the third preferred embodiment of the present invention.
Figure 14:
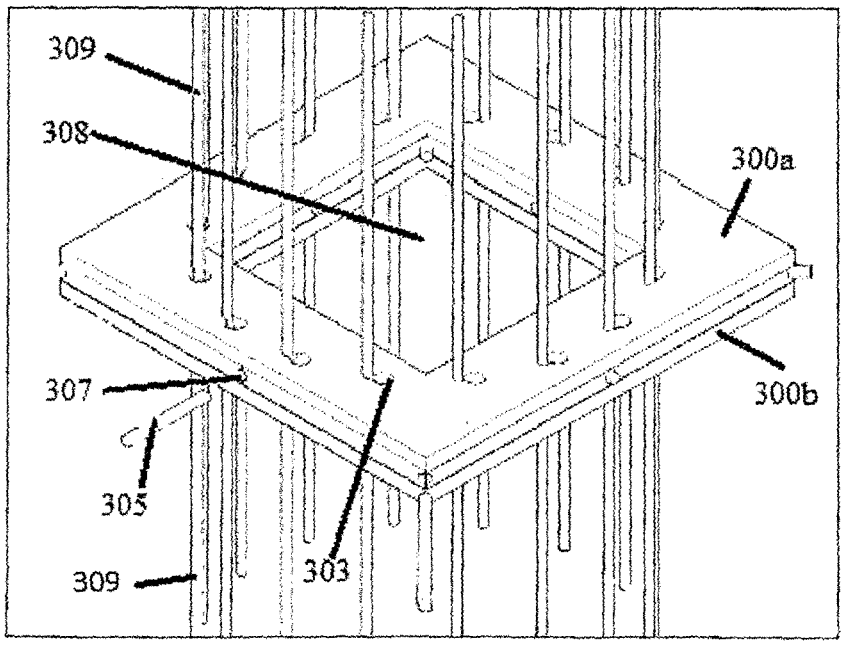
FIG. 14 is a diagram of two separate articles of the third preferred embodiment of the present invention that are mated together with rebars of the piles inserted to the holes.

The article of this embodiment could come in various shapes, including square, hexagonal and triangle. An example of a square article is illustrated in FIG. 13, whereby the lateral edges (306) of the protrusions (301) could be straight at 90° or inclined at a certain angle in relative to the periphery of the plate as long as the second configuration is complementary to the first configuration. As shown in. FIG. 14, the protrusions (301) and recesses (302) are fabricated with at least a hole (303) for receiving rebars (309) of the pile (310). This embodiment has features that are similar as the first preferred embodiment in which the lateral edges (306) are tapered upwards at an angle of less than 3° in relative to the vertical axis of the lateral edge (306) that is parallel to the longitudinal axis of the pile (310). The mated articles (300) have a gap of 1 mm to 5 mm formed between the contiguous protrusions (301). The passageway (307) is tapered towards the central opening (308) and has an opening for the pin (305) with a complementary diameter to fit thereinto.

Figure 15:
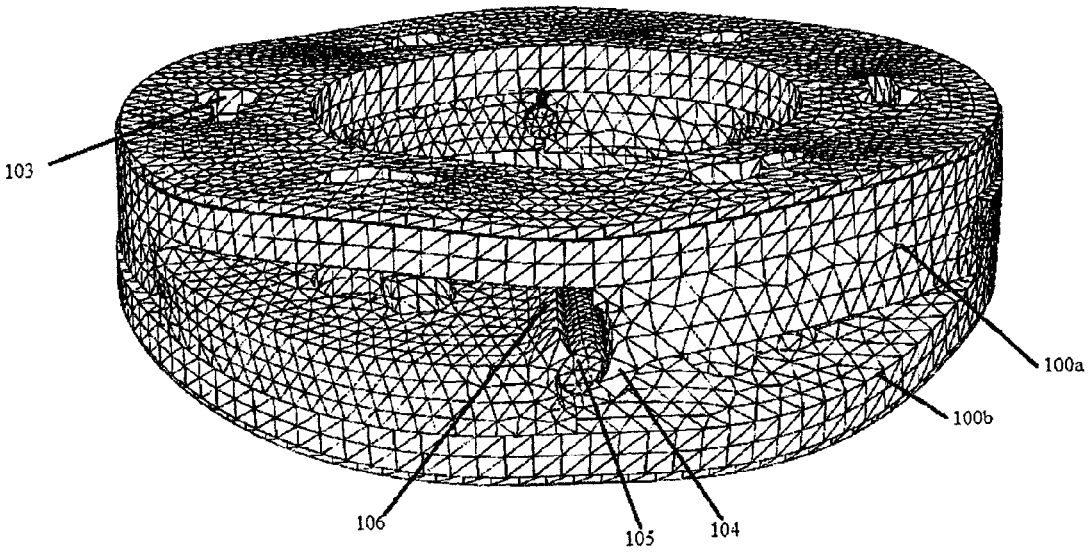
FIG. 15 shows the exaggerated distortion simulated through using the Finite Element Analysis that has been magnified 30 times of the actual deformation for a mated article used to connect two piles that has reached the ultimate bending moments pile capacity without disengagement.

The present invention is designed to allow insertion of pins (105, 209, 210, 305) that fit into the passageways (107, 206, 207,307) between the contiguous protrusions (101, 203, 205, 301) such that compression, tension, torsion and shear forces exerted onto the mated articles (100, 200, 300) are fully transferred to the edges (212) of the protrusions (203, 205) that are adjacent to the recesses (202, 204), the lateral edges (106, 213, 306) and the grooves (104, 214, 215, 304) surrounding the pins (105, 209, 210, 305). The radial surface of pins (105, 209, 210, 305) are able to engage and lock in full contact with the corresponding surface of the mated passageway (107, 206, 207, 307) to provide contact bearing resisting forces against the bending moment and axial force along the pile (110, 218). Therefore, such locking mechanism of the article (100, 200, 300) enables the mated articles (100, 200, 300) to be joined together for forming a joint stronger than the pile capacity to sustain stresses and resist bending and pulling forces. A simulation of the mated piles joined using the disclosed articles undergoing bending moments surpassing the nominal pile capacity is done using the Finite Element Analysis which showed the exaggerated distortion of the pins (105, 209, 210, 305) and the lateral edges (106, 215, 306) is able to cope well without drastic disengagement of the joint. The simulation result of the mated article is illustrated in FIG. 15.

The present invention has been designed such that the rebars (109, 211, 309) of the prestressed spun pile (110, 218) can be tensioned and locked into the array of holes (103, 208) of the respective article (100, 200, 300) and this tensioned force can be carried across the articles (100, 200, 300) into the next adjoined pile by the following actions: the pure compression axial load can be transmitted across the ends of the mated piles (110, 218) by bearing of the protrusions (101, 203, 205, 301) against the recesses (102, 202, 204, 302). The pure tension axial load is resisted across mated piles (110, 218) through the upper and lower vertical contact bearing surfaces between the pins (105, 209, 210, 305) and the passageway (107, 206, 207, 307) formed by the mated articles (100, 200, 300). The pure horizontal lateral shear force is resisted by the horizontal contact bearing surfaces between the pins and the passageway (107, 206, 207, 307) formed by the mated articles (100, 200, 300). In case of a flexural bending, the combined actions of the pure tension, compression and shear resistances described above come into play as illustrated in FIG. 15. Of an important criteria of this invention is that the bearing surfaces provided acting between the pins is far greater than the cross-section area of the tensioned rebars (109, 211, 309) which therefore enables greater or at least full bending, compressive and tensile capacity of the intact pile section to be carried across mated articles (100, 200, 300).

Although the description above contains many specifications, it is understood that the embodiments of the preferred form are not to be regarded as a departure from the invention and it may be modified within the scope of the appended claims.

The invention claimed is:

1. An article for coaxially joining concrete piles subjected to large vertical axial forces during pile driving comprising:

an annular plate which is mounted at one end of the pile, having a central opening, a front surface and an obverse surface, the front surface provided with an interlocking profile having a plurality of first and second complementary configurations, each configuration is defined in a substantially equal-sized sector and arranged radially in an alternate fashion on the front surface, where the first configuration is a protrusion and the second configuration is a recess, wherein the lateral edges of each protrusion form a tapered horizontal groove extending toward the central opening;

whereby mating of two identical annular plates, that are each mounted at the ends of two separate piles, at the interlocking profiles through registering the protrusions of one article to the recesses of another article lead to the formation of a passageway by two adjacently positioned grooves of two contiguous protrusions of the mated articles, the passageway allows interlocking of the mated articles by inserting a tapered pin there through.

2. An article according to claim 1 wherein the protrusions and recesses are fabricated with a plurality of holes for receiving rebars of the pile extending between annular plates at each pile end to pre-stress the piles in compression.

3. An article according to claim 1, wherein the protrusions have lateral edges that are tapered upwards at an angle of less than 3° in relative to the vertical axis of the lateral edge that is parallel to the longitudinal axis of the pile.

4. An article according to claim 1, wherein the mated articles have a gap of 1 mm to 5 mm formed between the contiguous protrusions.

5. An article according to claim 1, wherein the passageway is tapered towards the central opening.

6. An article according to claim 1, wherein the pin has a complementary diameter to fit into the opening of the passageway.

7. An article according to claim 1, wherein the passageway formed from the two adjacent grooves has a cross-sectional shape of either oval, rectangular, square or circular.

8. An article for joining concrete piles comprising;

an annular plate which is mounted at one end of the pile having a central opening, a front surface and an obverse surface, the front surface provided with an interlocking profile having a plurality of first and second complementary configurations, each configuration is defined in a substantially equal-sized sector and arranged radially in an alternate fashion on the front surface, that the first configuration has a segmental recess coupled with a non-segmental protrusion within the sector while the second configuration has a non-segmental recess coupled with a segmental protrusion within the sector, wherein the edges of the segmental protrusions and non-segmental protrusions that are adjacent to the recesses carry a first groove;

whereby mating of two identical articles, that are mounted at the ends of two separate piles, at the interlocking profiles through registering the protrusions of one article to the recesses of another article leads to the formation of a first passageway by two adjacently positioned first grooves of a pair of contiguously placed non-segmental protrusion and segmental protrusion of the mated articles, the first passageway allows interlocking of the mated articles by inserting a first pin there through.

9. An article according to claim 8, wherein the non-segmental protrusions and non-segmental recesses are fabricated with a plurality of holes sized for receiving rebars of the pile extending between annular plates at each pile end to pre-stress the piles in compression.

10. An article according to claim 8, wherein the segmental protrusions and non-segmental protrusions that are adjacent to the recesses have edges which are tapered upwards at a first angle of less than 3° in relative to the vertical axis of the edge that is parallel to the longitudinal axis of the pile.

11. An article according to claim 8, wherein the mated articles have a first gap (221) of 1 mm to 5 mm formed between the contiguously placed non-segmental protrusion and segmental protrusion.

12. An article according to claim 8, wherein the segmental protrusions and non-segmental protrusions have lateral edges that are fabricated with a horizontally extending second groove such that a second passageway is formed by two adjacently positioned second grooves of two contiguous non-segmental protrusions and two contiguous segmental protrusions of the mated articles.

13. An article according to claim 12, wherein the second passageway allows interlocking of the mated articles by inserting a second pin there through.

14. An article according to claim 12, wherein the lateral edges of the protrusions are tapered upwards at a second angle of less than 3° in relative to the vertical axis of the lateral edge that is parallel to the longitudinal axis of the pile.

15. An article according to claim 12, wherein the mated articles have a second gap of 1 mm to 5 mm formed between the two contiguous non-segmental protrusions and the two contiguous segmental protrusions.

16. An article according to claim 12, wherein the second passageway is tapered towards the central opening.

17. An article according to claim 8, wherein the first pin and second pin have a complementary diameter to fit into the opening of the first passage and second passageway respectively.

18. An article for joining concrete piles subjected to large vertical axial forces during pile driving comprising:

a plate which is mounted at one end of the pile, having a central opening, a front surface and an obverse surface, the front surface provided with an interlocking profile having a plurality of first and second configurations, each configuration is defined as a section arranged in an alternate fashion on the front surface, that the first configuration is a protrusion and the second configuration is a recess that complements to the first configuration, wherein the lateral edges of each protrusion diverge from the central opening and carry a horizontally extending tapered groove extending toward the central opening;

whereby mating of two identical articles, that are each mounted at the ends of two separate piles, at the interlocking profiles through registering the protrusions of one article to the recesses of another article leads to the formation of a passageway by two adjacently positioned grooves of two contiguous protrusions of the mated articles, the passageway allows interlocking of the mated articles by inserting a gently tapered pin there through.

* * * * *